United States Patent [19]

Ostendorff et al.

[11] Patent Number: 4,744,781

[45] Date of Patent: May 17, 1988

[54] AMPHIBIOUS TOY VEHICLE

[75] Inventors: Eric C. Ostendorff; Peter C. Crosson, both of Torrance; Samuel M. Goldstein, Los Angeles; Daniel H. Meggs, Yorba Linda, all of Calif.

[73] Assignee: Mattel, Inc., Hawthorne, Calif.

[21] Appl. No.: 273

[22] Filed: Jan. 2, 1987

[51] Int. Cl.[4] ..... A63H 23/04

[52] U.S. Cl. ..... 446/164; 446/462; 446/465; 114/270; 440/92

[58] Field of Search ..... 446/164, 163, 165, 160, 446/153, 154, 465, 462, 448, 457; 114/270; 440/92

[56] References Cited

U.S. PATENT DOCUMENTS 2,775,062 12/1956 Gibson, Jr. et al. ..... 446/164
3,099,977 8/1963 McLarty .
3,600,847 8/1971 Lakin ..... 446/164
3,970,029 7/1976 Bibaut .
4,540,376 9/1985 Turbowitz et al. ..... 446/164
4,547,166 10/1985 Goldfarb et al. ..... 446/164

*Primary Examiner*—Mickey Yu

*Attorney, Agent, or Firm*—Ronald M. Goldman; Melvin A. Klein; Daniel F. Sullivan

[57] ABSTRACT

An amphibious toy vehicle having paddles located within the wheels of the toy vehicle which can be extended outside the wheels in order to propel the vehicle forward and backward in water. A flotation chamber is provided at the bottom of the vehicle. A gear assembly including rack gears is used to extend and retract the paddles. After the paddles are retracted inside the wheels, the toy vehicle may be moved over a supporting surface by the rotating wheels. A downwardly extending portion attached to an upper body of the amphibious toy vehicle helps to keep motors mounted inside the vehicle dry when the toy vehicle is placed in water.

6 Claims, 5 Drawing Sheets

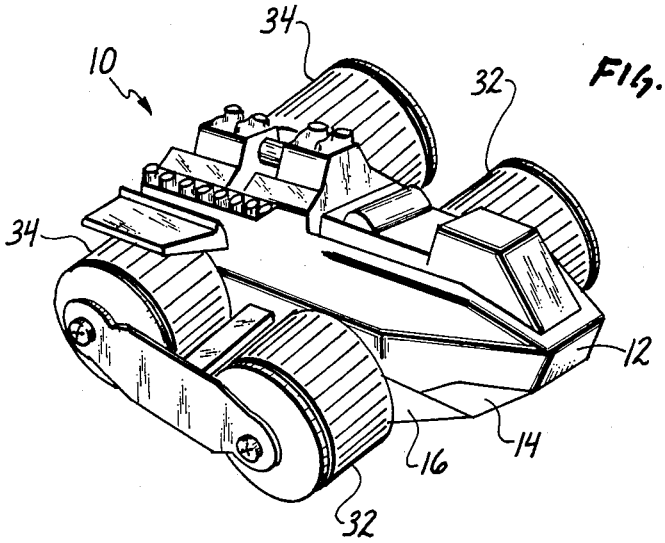
FIG. 1
FIG. 6
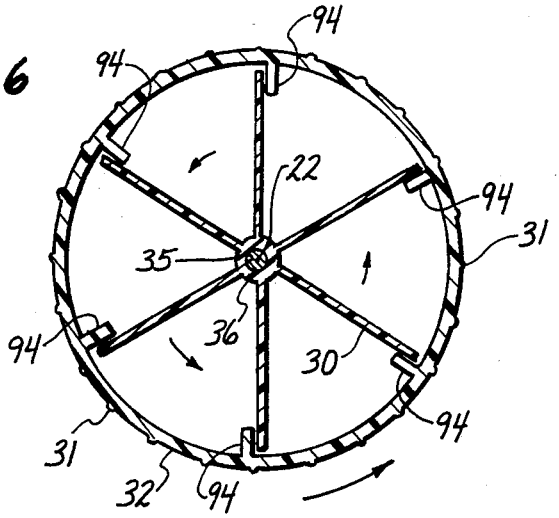

AMPHIBIOUS TOY VEHICLE

BACKGROUND OF THE INVENTION

The present invention relates generally to toy vehicles and, more particularly, to an amphibious toy vehicle having paddles located within the wheels of the vehicle which may be extended outside the wheels to propel and stabilize the vehicle in water.

In the past, a variety of amphibious toy vehicles have been made such as those disclosed in U.S. Pat. Nos. 4,547,166; 4,540,376; and 3,600,847. Other amphibious vehicles are described in U.S. Pat. Nos. 3,970,029 and 3,099,977. However, none of these patents discloses an amphibious toy vehicle having paddles located within the wheels of the vehicle which may be extended outside the wheels. Once extended, the paddles may be used to propel the amphibious vehicle back and forth in the water. After the paddles are retracted inside the wheels, the toy vehicle may be moved over a supporting surface by the rotating wheels. As such, a child can pretend that the toy vehicle is either a boat or a car. Accordingly, there is a need in the toy manufacturing arts for the aforementioned amphibious toy vehicle.

SUMMARY OF THE INVENTION

It is an object of this invention to provide an amphibious toy vehicle having paddles located within the wheels of the vehicle which may be extended outside the wheels to propel and stabilize the vehicle in water.

It is another object of this invention to provide an amphibious toy vehicle having two motors, one for propelling the vehicle forward and backward and the other for extending and retracting the paddles located inside the vehicle wheels.

It is still another object of this invention to provide an amphibious toy vehicle which uses a gear assembly including rack gears to extend and retract the paddles located inside the vehicle wheels.

It is still another object of this invention to provide an amphibious toy vehicle having a downwardly extending portion which helps to keep motors mounted inside the vehicle dry when the toy vehicle is placed in water.

These and other objects and advantages are attained by an amphibious toy vehicle having paddles located within the wheels of the toy vehicle which can be extended outside the wheels in order to propel the vehicle forward and backward in water. A flotation chamber is provided at the bottom of the vehicle. A gear assembly including rack gears is used to extend and retract the paddles. After the paddles are retracted inside the wheels, the toy vehicle may be moved over a supporting surface by the rotating wheels. A downwardly extending portion attached to an upper body of the amphibious toy vehicle helps to keep motors mounted inside the vehicle dry when the toy vehicle is placed in water.

The various features of the present invention will be best understood together with further objects and advantages by reference to the following description of the preferred embodiment taken in connection with the accompanying drawings.

BRIEF DESCRIPTION OF THE DRAWINGS

FIG. 1 is a perspective view of the amphibious toy vehicle;

FIG. 6 is a sectional view taken along line 6—6 of FIG. 5 illustrating how radial ribs inside the wheels engage the paddles causing the paddles to rotate.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that varous modifications can be accomplished within the parameters of the present invention.

Figure 2:
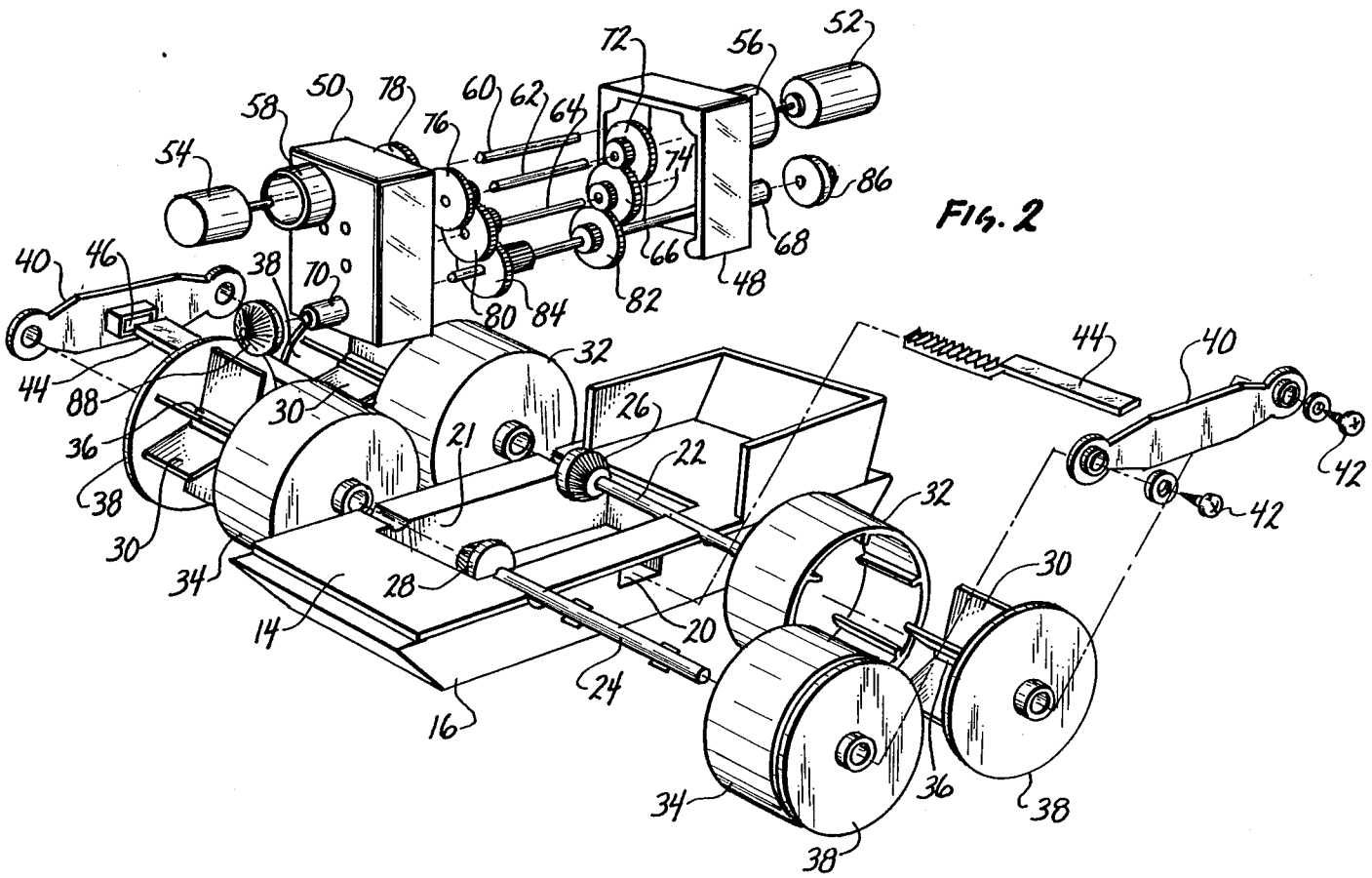
FIG. 2 is an exploded perspective view showing the gear assemblies, wheels and paddles used for the toy vehicle.
Figure 3:
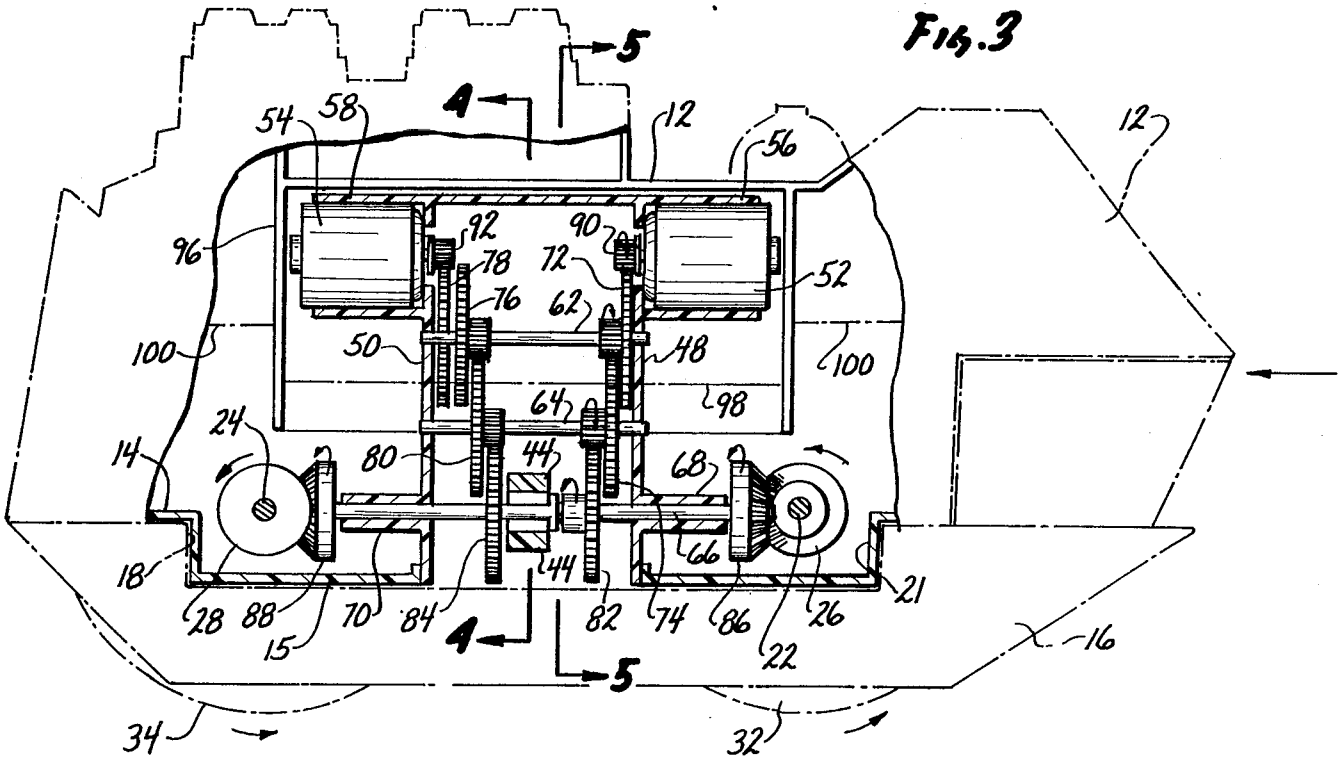
FIG. 3 is a sectional view with part of the toy vehicle broken away showing how one of the gear assemblies is used to rotate the wheels of the toy vehicle.

Referring now to the drawings and particularly to FIGS. 1 through 3, an amphibious toy vehicle 10 of the present invention is shown having an upper body 12 which is attached to a lower body 14. A flotation chamber 16 is attached to the bottom of the lower body 14. The chamber 16 is preferably fabricated using blow molding techniques and has hollow portions which provide buoyancy for the toy vehicle 10 allowing it to float in water. The flotation chamber 16 has an opening 18 formed in its top side (see FIG. 3) and slots 20 passing through sides formed by the opening 18 (only one of the two slots 20 is shown in FIG. 2). A downward extension 15 of the lower body 14 engages opening 18 in the flotation chamber 16 forming a second opening 21 as shown in FIG. 3. Openings 18 and 21 provide needed space for mounting the gear assemblies used for the toy vehicle 10 helping to lower the center of gravity of the vehicle.

Figure 4:
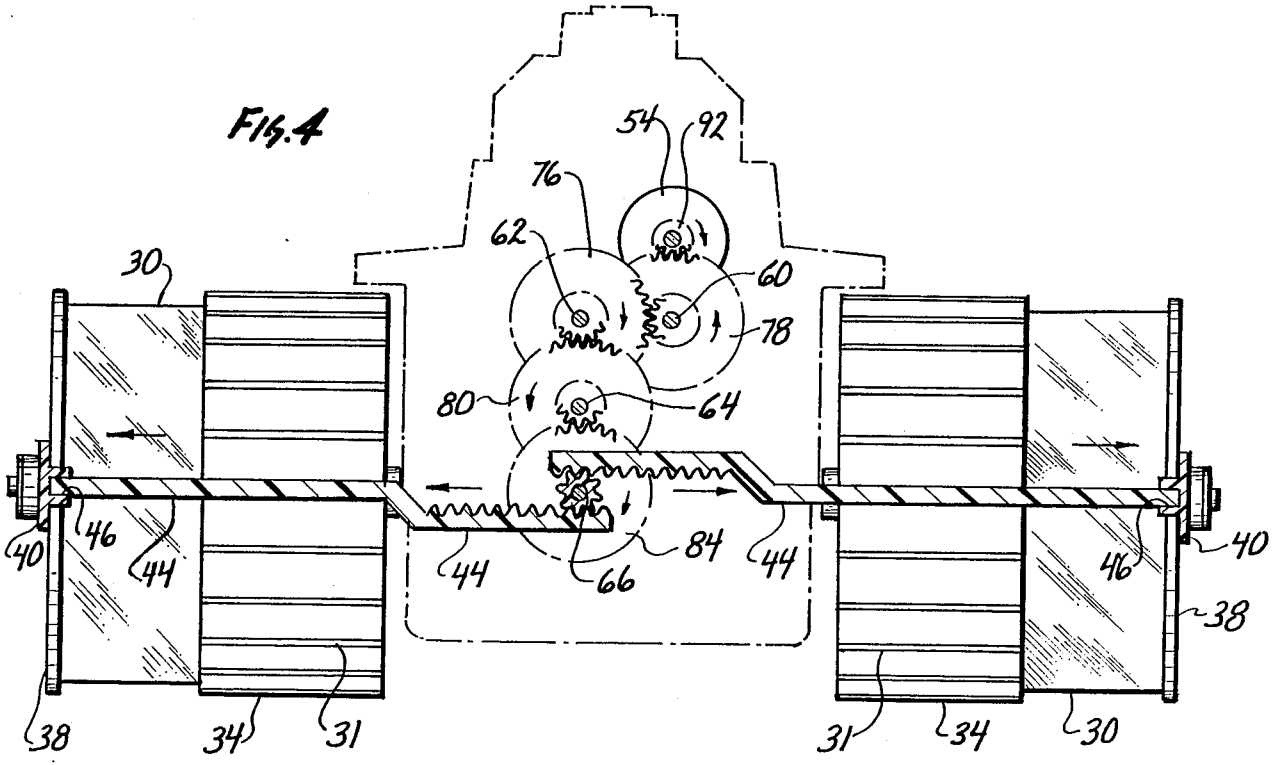
FIG. 4 is a sectional view taken along line 4—4 of FIG. 3 showing how another gear assembly is used to extend the paddles.

Front and rear axles 22 and 24, respectively, are rotatably mounted on the lower body 14 (see FIG. 2). Bevel gears 26 and 28 are attached to the axles 22 and 24. Front and rear wheels 32 and 34, respectively, are attached to the axles 22 and 24. The wheels 32 and 34 are preferably press fit onto the axles 22 and 24 and rotate with the axles. Paddles 30 slidably engage the axles 22 and 24 of the toy vehicle 10. As illustrated in FIG. 6, the axles 22 and 24 engage apertures 35 in hubs 36 of the paddles 30. Each paddle 30 has a flat disk 38 attached to it as shown in FIG. 2. The paddles 30 fit inside the wheels 32 and 34 and are free to extend outside the wheels as they slide along the longitudinal axes of the axles 22 and 24 as illustrated in FIG. 4.

Referring again to FIG. 2, outrigger members 40 are attached to the flat disks 38 by fasteners 42. Any convenient means may be used to fasten the members 40 to the disks 38. Each outrigger member 40 is attached to two of the flat disks 38 on the same side of the toy vehicle 10 so that two paddles 30 on one side of the vehicle extend outward from inside the wheels 32 and 34 at the same time, or both move together. In addition, each outrigger member 40 has a rack gear 44 attached to it as shown in FIGS. 2 and 4. The rack gears 44 are preferably press fit into apertures 46.

Referring now to FIGS. 2 and 3, front and rear gear housings 48 and 50, respectively, are attached together and mounted on the lower body 14 of the toy vehicle. Two motors 52 and 54 are mounted in cylindrical extensions 56 and 58, respectively, of the housings 48 and 50. Gear shafts 62 through 64 are mounted in the housings 48 and 50. In addition, drive shaft 66 is rotatably mounted in cylindrical extensions 68 and 70 attached to the housings 48 and 50. Gears 72 through 80 are rotatably mounted on shafts 60 through 64. Gear 82 is attached to drive shaft 66 and gear 84 is rotatably mounted on the same shaft 66. Bevel gears 86 and 88 are attached to the ends of shaft 66 which extend past cylindical extensions 68 and 70. Finally, gears 90 and 92 are attached to shafts extending from motors 52 and 54, respectively.

Figure 5:
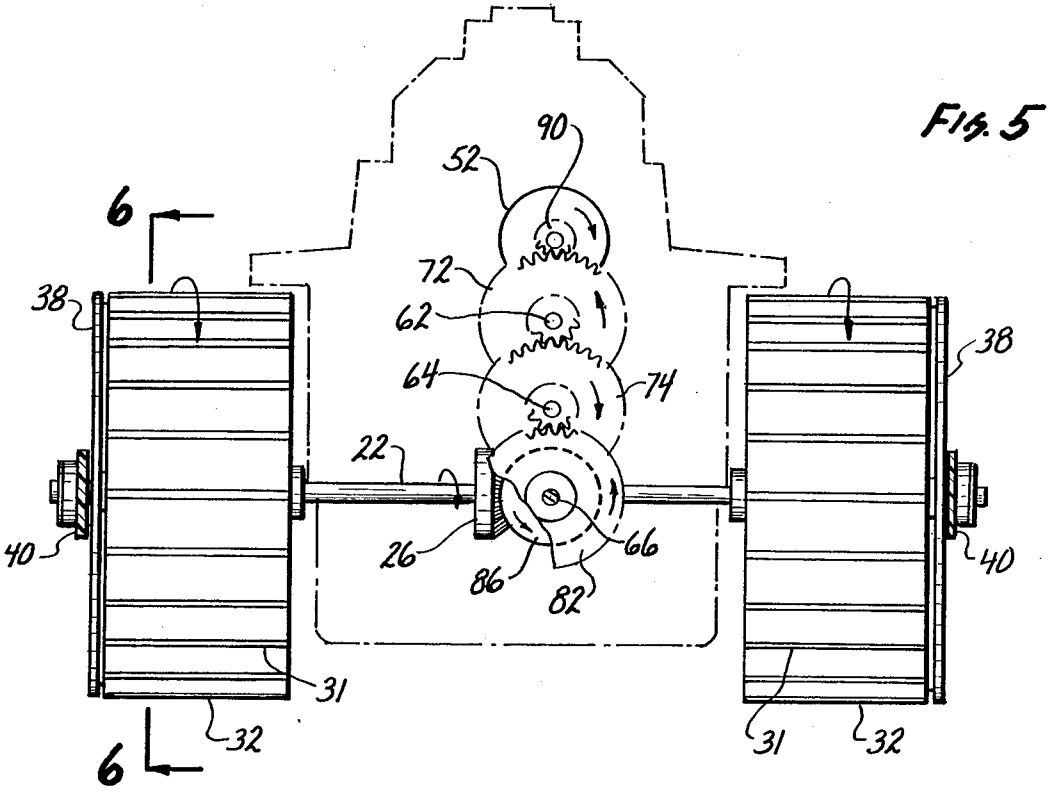
FIG. 5 is a sectional view taken along line 5—5 of FIG. 3 showing the front wheels of the toy vehicle being rotated.

Gears 72, 74, 82 and 90 engage as shown in FIGS. 3 and 5. Bevel gears 26, 28, 86 and 88 also engage as shown. As such, when motor 52 causes gear 90 to rotate in the direction of the arrow shown in FIGS. 3 and 5, gears 72, 74 and 82 will rotate as indicated by the arrows shown in these figures. Shaft 66 will then rotate in the same direction as gear 82 causing bevel gears 26, 28, 86 and 88 to rotate as shown in the figures. This, in turn, causes wheels 32 and 34 to rotate in a counterclockwise direction as shown in FIG. 3 resulting in the toy vehicle 10 moving backward. Conversely, if motor 52 causes gear 90 to rotate in a direction opposite to the arrows shown in FIGS. 3 and 5, then the toy vehicle 10 will move forward.

FIGS. 3 and 4 show how gears 76, 78, 80, 84 and 92 engage and how gear 84 engages rack gears 44. If motor 54 causes gear 92 to rotate in the direction of the arrow shown in FIG. 4, then gears 76, 78, 80 and 84 will rotate as shown in this figure. Since gear 84 is free to rotate on drive shaft 66, the rack gears 44 will move horizontally as shown in FIG. 4 causing the outrigger members 40 to move away from the wheels 32 and 34 and the paddles 30 to extend outside the wheels. If motor 54 causes gear 92 to rotate in a direction opposite to the arrow shown in FIG. 4, then the paddles 30 will be retracted inside the wheels 32 and 34.

As illustrated in FIG. 6, rotation of the wheels 32 and 34 will cause the paddles 30 to rotate in the same direction as the wheels due to radial ribs 94 located on the inside of each wheel. For example, if wheel 32 is caused to rotate in the direction of the arrows shown in FIG. 6, then the radial ribs 94 will cause the paddle 30 to rotate in the same direction pushing the paddle in the direction of rotation The buoyancy of the flotation chamber 16 is determined so that the water level inside the toy vehicle 10 will be established at approximately the level of the axles 22 and 24 when the vehicle is floating in water.

A downwardly entending portion 96 of the upper body 12 inside the toy vehicle 10 is provided to help keep the motors 52 and 54 dry in case a child causes the water level to rise inside the vehicle by pushing on top of the vehicle while it floats in water. In such a case, the water level inside the downwardly extending portion 96 represented by line 98 will be lower than the water level outside the portion represented by line 100 due to trapped air pressure. The downwardly extending portion 96 surrounds the motors 52 and 54 providing an internal chamber which helps to keep the motors dry.

A child may play with the amphibious toy vehicle 10 by placing it in water and then extending the paddles 30 outside the wheels 32 and 34 by activating motor 54. The vehicle 10 may then be moved forward or backward in the water by using motor 52 to rotate the paddles 30. The toy vehicle 10 may also be moved over a supporting surface after it is taken out of the water by retracting the paddles 30 inside the wheels 32 and 34 and propelling the vehicle across the surface using the wheels powered by motor 52. The wheels 32 and 34 preferably have cleats or protuberances 31 to assist in providing traction.

The toy vehicle 10 may be played with like an amphibious vehicle by moving it along the ground until it reaches water and then extending the paddles 30 out of the wheels 32 and 34 as it enters the water. Conversely, the paddles 30 may be retracted inside the wheels 32 and 34 as the toy vehicle 10 leaves the water and rolls onto the ground. Any means of activating or energizing the motors 52 and 54 may be used such as batteries, hand held radio or tether (electrical wires) controlled units, other remote controlled units, or the like.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. An amphibious toy vehicle comprising:
a vehicle body;
a flotation chamber attached to said body;
two axles rotatably mounted on said body;
wheels attached to said axles;
paddles slidably engaged to said axles, said paddles capable of retracting inside said wheels, extending outside said wheels and rotating with said wheels;
means for rotating said axles; and
means for extending said paddles outside said wheels and retracting said paddles inside said wheels.

2. The amphibious toy vehicle of claim 1 wherein said rotating means includes:
a drive shaft rotatably mounted on said body;
a gear attached to said drive shaft;
first bevel gears attached to said drive shaft;
second bevel gears attached to said axles, said second bevel gears engaging said first bevel gears;
a first gear assembly rotatably mounted on said body and engaged to said gear attached to said drive shaft; and
a first motor mounted on said body, said first motor engaging said first gear assembly.

3. The amphibious toy vehicle of claim 2 wherein said means for extending and retracting said paddles includes:
a gear rotatably engaged to said drive shaft;
a second gear assembly rotatably mounted on said body and engaged to said gear rotatably engaged to said drive shaft;
a second motor mounted on said body, said second motor engaging said second gear assembly;
outrigger members attached to said paddles; and
rack gears attached to said outrigger members, said rack gears engaging said gear rotatably engaged to said drive shaft.

4. The amphibious toy vehicle of claim 3 wherein said wheels have radial ribs attached thereto, said radial ribs capable of contacting said paddles when said wheels are rotating.

5. An amphibious toy vehicle comprising:

a vehicle body;

a flotation chamber attached to said body;

front and rear axles rotatably mounted on said body;

front wheels attached to said front axle;

rear wheels attached to said rear axle;

paddles slidably engaged to said axles, said paddles capable of retracting inside said wheels, extending outside said wheels and rotating with said wheels;

first motor means mounted on said body for rotating said wheels;

a drive shaft rotatably mounted on said body;

first gear means for engaging said first motor means to said drive shaft;

second gear means for engaging said drive shaft to said axles;

second motor means mounted on said body for extending said paddles outside said wheels and retracting said paddles inside said wheels;

a gear rotatably engaged to said drive shaft;

third gear means for engaging said second motor means to said gear rotatably engaged to said drive shaft; and rack gears attached to said paddles and engaged to said gear rotatably engaged to said drive shaft.

6. The amphibious toy vehicle of claim 5 further comprising outrigger members attached to said paddles and said rack gears.

* * * * *